US005342043A

United States Patent [19]

Baltronis et al.

[11] Patent Number: 5,342,043

[45] Date of Patent: Aug. 30, 1994

[54] SPLIT WEIGHT BLADDER FOOTBALL

[75] Inventors: Joseph F. Baltronis, Agawam; Thomas J. Kennedy, Chicopee, both of Mass.

[73] Assignee: Lisco, Inc., Tampa, Fla.

[21] Appl. No.: 112,919

[22] Filed: Aug. 30, 1993

[51] Int. Cl.[5] ..... A63B 41/00

[52] U.S. Cl. ..... 273/65 EC; 273/65 EF

[58] Field of Search ..... 273/65 EC, 65 R, 65 A, 273/65 B, 65 EF, 65 E, 65 ED, 65 EG, 65 F, 58 BA, 55 R, DIG. 20

[56] References Cited

U.S. PATENT DOCUMENTS

| | | | |
|---|---|---|---|
| 1,597,308 | 8/1926 | Brandt | 273/65 EC |
| 1,604,044 | 10/1926 | Hart | 273/65 EC |
| 1,649,458 | 11/1927 | Fewlass | 273/65 EC |
| 2,113,467 | 5/1938 | Levinson | 273/65 A |
| 2,244,503 | 6/1941 | Riddell | 273/65 |
| 2,364,247 | 12/1944 | Shearer | 273/65 |
| 2,653,818 | 9/1953 | Tebbetts, Jr. et al. | 273/65 |
| 3,475,027 | 10/1969 | Henderson | 273/65 |
| 3,508,750 | 5/1970 | Henderson | 273/65 |
| 3,512,777 | 6/1970 | Henderson | 273/65 |
| 3,884,466 | 5/1975 | MacDonald et al. | 273/65 EC |
| 3,948,518 | 5/1976 | Tebbetts, Jr. | 273/65 EG |
| 4,003,574 | 1/1977 | MacDonald et al. | 273/65 EC |
| 4,327,912 | 5/1982 | Hoffman | 273/61 R |
| 4,462,590 | 7/1984 | Mitchell | 273/65 E |
| 4,616,827 | 10/1986 | Bergland | 273/58 A |
| 4,925,195 | 5/1990 | Di Manno | 273/428 |
| 5,000,451 | 3/1991 | MacDonald et al. | 273/65 EC |
| 5,098,097 | 3/1992 | Kennedy et al. | 273/65 EC |
| 5,224,704 | 7/1993 | Snell | 273/65 EF |

FOREIGN PATENT DOCUMENTS

| | | | |
|---|---|---|---|
| 499656 | of 1939 | United Kingdom | 273/DIG. 20 |

*Primary Examiner*—George J. Marlo

[57] ABSTRACT

A football comprising a generally elliptical bladder, generally oval panels seamed thereover, lacing components along one seam and at least a pair of spaced apart counterweights secured to the bladder at locations spaced from a location diametrically opposite said lacing components and equal to the weight of said lacing components so that there is no abatement of punting or kicking efficiency while still allowing a true spiral pass to be thrown.

16 Claims, 1 Drawing Sheet

SPLIT WEIGHT BLADDER FOOTBALL

BACKGROUND OF THE INVENTION

1. Field of the Invention

This invention relates to a split weight bladder football and, more particularly, to a football of essentially conventional construction but with weight patches formed interiorly of the panels at locations opposed from the lacing to eliminate the off center, rotational weight of the lacing and associated components when a spiral pass is thrown.

2. Description of the Background Art

Current American footballs are constructed with a one-piece, inflatable, generally elliptically shaped, bladder which is covered by four generally oval-shaped panels seamed together along their edges. One of the seams is not stitched along a central extent thereby forming an opening to allow the bladder to be inserted to within the panels during fabrication. After insertion, the opening is closed through lacing and associated components. As a result, a football is not symmetrically weighted around its periphery due to the concentration of weight in the area of the lacing. Consequently, when a pass is thrown which spirals about its longitudinal axis, the concentration of weight at the lacing results in rotational forces which cause the ball to move in other than a straight path of travel.

Footballs do not contain anything to promote the throwing of a true spiral pass. No additional components such as a weighting system has ever been placed within the construction of the panels of a football to stop the effect of the offset weight in the lacing area so as to facilitate a true spiral pass.

Various devices are commercially used or are disclosed in the patent literature for facilitating the true spiraling of footballs or for improving the seam area of balls, including footballs. By way of example, U.S. Pat. Nos. 3,884,466 and 4,003,574, both to McDonald, disclose techniques for throwing a true spiral. McDonald's footballs, however, rely upon a central longitudinal passage for improving flight characteristics. U.S. Pat. Nos. 3,475,027; 3,508,750 and 3,512,777, all to Henderson, disclose a game ball seam with raised areas and with inwardly directed depressions adjacent to the raised seams. Covering sections are provided on the surface of the ball between the seams. Nothing is directed to improving football spiraling. Other seaming arrangements are disclosed in U.S. Pat. Nos. 2,653,818 and 3,948,518 to Tibbits. But as in the Henderson patents, a multi-layer seam is placed at all seams thereby failing to counterbalance the single area of the lacing. Again, nothing is directed to improving football spiraling. In addition, U.S. Pat. No. 4,462,590 to Mitchell discloses a game ball with padding and enlarged seams, the padding adapted to increase the holdability of the ball when throwing or catching. Once again, nothing is directed to improving football spiraling. Lastly, note is taken of U.S. Pat. No. 5,098,097 to Kennedy and Baltronis, the inventors of the instant application and assigned to the assignees of the instant application. According to such patent, a simple counterweight is employed interiorly of the bladder, diametrically opposite from, and equal to the weight of the lacing components so that a non-wobbly spiral pass may be thrown. Unfortunately, such positioning of a single counterweight patch may constitute an encumbrance to the normal kicking and punting of the football in which it is provided.

As evidenced by the above-referred to patents, as well as other commercial devices, a wide variety of devices have been designed with modifications in the seam or other areas for use in improving game balls or the ability to throw a spiral pass, but not of a conventional football. No prior patent or commercial device, however, is directed to a device as disclosed and claimed herein.

Accordingly, it is an object of the present invention to provide an American football comprising a generally elliptical bladder, generally oval panels seamed thereover, lacing components along one seam and counterweights secured to the bladder at locations spaced from a location diametrically opposite said lacing components and equal to the weight of said lacing components.

It is a further object of the present invention to facilitate the throwing of true spiral passes with an American football.

It is a further object of the invention to place weights inside the panels of a football to counterbalance the nonsymmetrical weight caused by the lacing and associated components.

It is a further object of the present invention to counteract the effects of the weight caused by components associated with the acing region of the football.

Lastly, it is an object of the present invention to counterbalance the weight of the lacing and associated component of a football by a pair of weights positioned on the inside of the bladder laterally offset from the location diametrically opposite the lacing components.

The foregoing has outlined some of the more pertinent objects of the invention. Those objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purposes of summarizing the invention, the invention may be incorporated into an American football comprising an inflatable, one-piece bladder formed in a generally elliptical shape and fabricated of an elastomeric material; four panels secured together over the bladder, each panel being of a similar, generally oval shape with inturned edges secured together by stitching to form four seams; an essentially inextensible liner formed of four liner components, each liner component being of a similar, generally oval shape with inturned edges secured together and to an associated panel by stitching to form four seams, the liner components being located between the panels and the bladder; an opening formed centrally along a part of one seam at a location where the panels and liner components are not stitched; lacing located along the opening to couple the inturned edges in place of the stitching; closure means comprising two patches and a tongue located between the bladder and liner components, the patches being stitched to the liner component and panels on opposite sides of the opening, the tongue being stitched to a liner component and panel and extending to a location between the bladder and patches; and counterweights of an elastomeric material, each of a weight substantially equal to half that of said lacing and closure means and molded to the bladder internally thereof and spaced from the seam of the panels opposite said lacing.

The foregoing has outlined rather broadly the more pertinent and important features of the present invention in order that the detailed description of the invention that follows may be better understood so that the present contribution to the art can be more fully appreciated. Additional features of the invention will be described hereinafter which forte the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed lo description taken in connection with the accompanying drawings in which.

Similar reference characters refer to similar parts throughout the several views of the drawings.

DETAILED DESCRIPTION OF THE PREFERRED EMBODIMENTS

Figure 1:
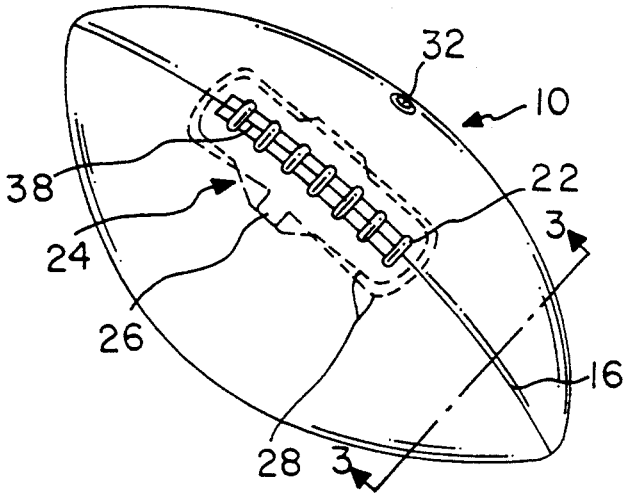
FIG. 1 is a perspective illustration of a football including the weighting system adapted to carry out the principles of the present invention.
Figure 2:
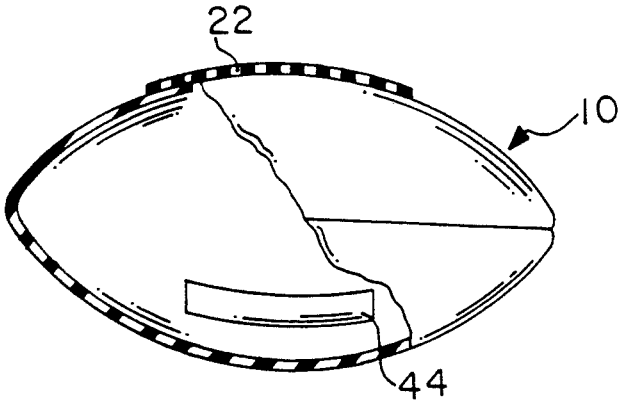
FIG. 2 is a plan view of the football of FIG. 1 with a part in section to show certain internal constructions.

Shown in the drawings with particular reference to FIG. 1, the present invention is illustrated as an American football 10. The American football 10 is a generally elliptically shaped object with an elongated, longitudinal, central axis. It is constructed with an internal, generally elliptically shaped bladder 12 and external, generally oval shaped panels 14 coupled together at their edges by stitches 16 and positioned over the bladder 12. Four essentially similarly shaped, generally oval shaped panels 14 are normally utilized with the panels 14 in abutment along their edges whereat their edges are unturned and stitched. An inextensible liner, formed of liner components 18, is located between the bladder 12 and the panels 14. The liner components 18 are of a generally oval configuration, corresponding in shape, size and number to the panels 14 to which they are stitched. Along one of the sees are lacing 22 and a closure assembly 24. The closure assembly 24 includes a tongue 26 and patch material 28. The lacing 22 and closure assembly 24 are used during fabrication as will be described in greater detail hereinafter. The final component of the football 10 is a valve 32. The valve 32 extends through a hole in the center of one panel 14 and in the bladder 12 for inflation and deflation purposes.

The purpose of the present invention is to use a weighting system to provide a truer spiral for a football 10 when thrown. Current footballs do not have a true spiral due to the offset weight which resides in the lacing area. The lacing area includes the lacing 22, the patch material 28 stitched to the panels 14 and liner 11 under the lacing 22 and the tongue 26 between the bladder 2 and patch material 28. The concept behind the present invention is to stop the wobble caused by the lacing area weight by offsetting it with a similar weight on opposed sides of the ball 10. This enables the ball 10 to spiral true around the center axis of the ball 10. The premise being that a ball that spirals truer will fly more accurately. The weighting is accomplished by applying weights or weight strips or patches, as of a high density filler, preferably of barium sulfate, a baryte, or a tungsten powder, in a polymer binder, such as butyl rubber, located internal to the football 10 of a proper size, shape and weight and at the proper and precise location.

The preferred weight patches are a pair of elongated, rectangular members of an elastomer such as butyl rubber compound with barytes or tungsten powder for increased density. The patches are between about 12.5 to 13.5 grams in weight each, offsetting a similar weight caused by the increased weight of the lacing 22 and associated components, i.e., the tongue 26 and patch material 28. The patches are adhered to the bladder 12 in its production stage. The weight of the entire bladder 12 with weight patch is 100 to 105 grams.

Figure 3:
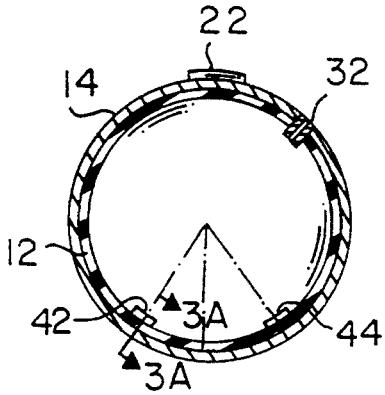
FIG. 3 is a sectional view of the football shown in FIG. 1 taken vertically across the center of its longitudinal axis.
Figure 4:
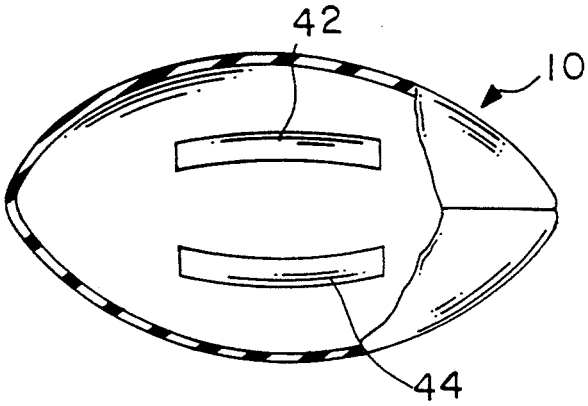
FIG. 4 is a bottom view of the football shown in FIG. 1 with a part in section to show certain internal constructions.
Figure 3A:
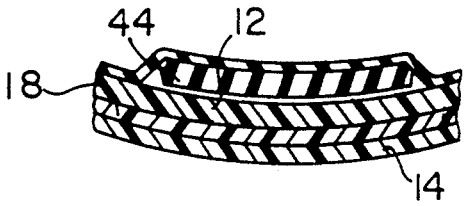
FIG. 3A is a sectional view of the football shown in FIG. 1, 2 and 3 taken along 3A—3A.

The patches function as counterweight and are preferably positioned in equal and opposite directions, angularly offset from the seam diametrically opposed from the laces and associated components. The angles of offset is preferably 30 degrees, plus or minus 10 percent, when measured from the seam therebetween. This is 150 degrees from the seam containing the laces. Note angle x of FIG. 3. Such location of the patches has been found to be preferred over the prior location on such seam in order to facilitate punting and kicking of the football. Punting and kicking is normally done by striking the ball with the foot at such diametrically opposed seam. When the patch is located at such prior location, the patch would constitute an encumbrance and distance would be lost. The use of two patches and their present locations symmetrically offset from the area to be struck by a punter or kicker results in no abatement of punting or kicking deficiency, distance or efficiency while still allowing a true spiral pass to be thrown.

The preferred liner material is an inextensible material for shape retention, preferably a polyethylene mesh impregnated with polyvinyl chloride. The liner material preferably weighs 28 ounces per square yard plus or minus 2.0 ounces. The four liner components 18 are to be 28 to 30 grams each for a total component weight of 112 to 120 grams.

The preferred panels 14 are preferably a treated leather which can be spit to as low as 0.060 to 0.063 inch to maintain the weight per panel 14 of 39.5 to 41.5 grams for a total weight of 158 to 166 grams for all the panels. The treating agent is a sticky substance which may be coated on the panels 14 but is preferably impregnated therein.

The preferred patch material 28 is made up either the leather or liner material with a total weight of the lacing 22 patch material 28, two in number, being 8 to 11 grams.

The preferred tongue 26 is made of leather and weighs 9 to 10 grams.

The preferred lacing 22, whether comprised of one or two lacing 22, is leather or a synthetic leather substitute and weighs 6 to 8 grams.

Such component material of the football 10 are all commercially available from a variety of sources.

This lacing 22, tongue 26 and patch material 28 are made up of various pieces that weigh 25 to 27 grams. They are of materials, sized and positioned to allow for the weight patch counteraction. The entire football weight is 393 to 420 grams.

The components of the football 10 are assembled in the conventional manner. Specifically, except for the bladder 12 and weight patches, all ball components are first cut to size. The liner components 18 are then sewn to the panels 14 along their peripheries. The edges of the panels 14 and liner components 18 are then stitched together along their edges forming seams and creating a football-shaped shell for receiving a pre-molded bladder 12. The stitching is effected while their panels 14 and liner 18 are inside out. A central extent along one seam is not stitched to thereby form an opening 38 through which the bladder 12 may be passed during fabrication. The tongue 26 and patch material 28 are then sewn into position to the panels 14 and liner 18 as shown in the Figures with the patch material 28 spanning the opening 38. The tongue 26 is sewn to a panel 14 and liner 18 along a short extent offset slightly from the patch material 28. The panels 14 and liner 18 are then turned outside out, and the bladder 12 is inserted. The bladder 12 is molded in one piece with two weight patches 42 and 44. The weight patches 42 and 44 are positioned at locations with their center offset about 30 degrees, plus or minus 10 percent, from the seam therebetween which is at a location about 150 degrees from the opening 38 and lacing 22. The opening 38 is then closed by lacing 22 with the tongue 26 having its enlarged portion located between the bladder 12 beneath the lacing 32 and patch material 28 thereabove. Each patch weighs between about 12½ to 13½ grams. Together they are of a weight essentially equal to the weight of materials in the area of the lacings.

The bladder 12 of the present invention is inserted into the carcass so that the line centrally between the weight patches 42 and 44 of the bladder 12 is directly opposite from a line containing the lacing 22 of the ball 10. In this manner, the weight patches means is oriented with respect to the remainder of the football proper weight distribution to allow the throwing of a true spiral without encumbering the kicking or punting of the football.

As used herein the terms "internal" and "external" as well as "over" and "under" are determined with respect to the radial direction when measured with respect to the central axis of the football.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. An American football comprising:

an inflatable, one-piece bladder formed in a generally elliptical shape and fabricated of an elastomeric material;

four panels secured together over the bladder, each panel being of a similar, generally oval shape with inturned edges secured together by stitching to form four seams;

an essentially inextensible liner formed of four liner components, each liner component being of a similar, generally oval shape with inturned edges secured together and to an associated panel by stitching to form four seams, the liner components being located between the panels and the bladder;

an opening formed centrally along a part of one seam at a location where the panels and liner components are not stitched;

lacing located along the opening to couple the inturned edges in place of the stitching;

closure means comprising two patches and a tongue located between the bladder and liner components, the patches being stitched to the liner component and panels on opposite sides of the opening, the tongue being stitched to a liner component and panel and extending to a location between the bladder and patches; and at least a pair of spaced apart counterweights of an elastomeric material, each of a weight substantially equal to half that of said lacing and closure means and molded to the bladder internally thereof and spaced from the seam of the panels opposite said lacing a predetermined distance so that there is no abatement of punting or kicking efficiency while still allowing a true spiral pass to be thrown.

2. A football comprising a generally elliptical bladder, generally oval panels seamed thereover, lacing components along one seam and at least two spaced apart counterweights secured to the bladder at locations spaced a predetermined distance from a location diametrically opposite said lacing components and equal to the weight of said lacing components, said predetermined distance being such that there is no abatement of punting or kicking efficiency while still allowing a true spiral pass to be thrown.

3. The football as set forth in claim 2, wherein the bladder is one piece and inflatable, formed in a generally elliptical shape and fabricated of an elastomeric material.

4. The football as set forth in claim 3, wherein the panels are of a similar, generally oval shaped with inturned edges secured together by stitching to form four seams.

5. The football as set forth in claim 4 and further including an essentially inextensible liner formed of four liner components, each liner component being of a similar, generally oval shape with inturned edges secured together and to an associated panel by stitching to form four seams, the liner components being located between the panels and the bladder.

6. The football as set forth in claim 5 and further including an opening formed centrally along a part of one seam at a location where the panels and liner components are not stitched.

7. The football as set forth in claim 4 and further including lacing located along the opening to couple the inturned edges in place of the stitching.

8. The football as set forth in claim 4 and further including closure means comprising two patches and a tongue located between the bladder and liner components, the patches being stitched to the liner components and panels on opposite sides of the opening, the tongue being stitched to a liner component and panel and extending to a location between the bladder and patches.

9. The football as set forth in claim 8 wherein the counterweights are of an elastomeric material and of a size and shape substantially equal to that of the lacing and closure means and molded to the bladder about 150 degrees from the lacing.

10. The football as set forth in claim 9 wherein the counterweights are elongated with a rectangular cross section.

11. The football as set forth in claim 10 wherein the counterweights are fabricated of an elastomeric material with a high density filler material.

12. The football as set forth in claim 11, wherein the elastomeric material is butyl rubber.

13. The football as set forth in claim 12, wherein the filler is barium sulfate.

14. The football as set forth in claim 12 wherein the filler is tungsten powder.

15. A football comprising:

an inflatable, one-piece bladder formed in a generally elliptical shape and fabricated of an elastomeric material;

panels secured together over the bladder, each panel being of a similar, generally oval shape with inturned edges secured together by stitching to form seams;

an opening formed centrally along a part of one seam at a location where the panels are not stitched;

closure means and lacing means located along the opening to couple the inturned edges in place of the stitching; and a plurality of spaced counterweights secured interiorly of the panels and of a weight corresponding to that of the closure means and lacing means to symmetrically balance the football so that a non-wobbly spiral pass may be thrown, said counterweight being two patches, each spaced in opposite directions about 150 degrees from said opening so that there is no abatement of punting or kicking efficiency while still allowing a true spiral pass to be thrown.

16. The football as set forth in claim 15 wherein each patch weighs between about 12.5 and 13.5 grams.

* * * * *